United States Patent [19]

Levine

[11] Patent Number: 4,718,607

[45] Date of Patent: Jan. 12, 1988

[54] ATOMIZED LIQUID SPRAY ORIFICE

[75] Inventor: Walter E. Levine, Port Huron, Mich.

[73] Assignee: Acheson Industries, Inc., Port Huron, Mich.

[21] Appl. No.: 891,746

[22] Filed: Jul. 30, 1986

[51] Int. Cl.[4] ..... B05B 1/04

[52] U.S. Cl. ..... 239/451; 239/597; 239/600; 239/601

[58] Field of Search ..... 239/597, 599, 600, 601, 239/451, 455

[56] References Cited

U.S. PATENT DOCUMENTS

| | | | |
|---|---|---|---|
| 2,172,193 | 9/1939 | Downs | 239/597 X |
| 2,260,987 | 10/1941 | D'arcy et al. . | |
| 2,492,873 | 12/1949 | Lamb . | |
| 2,564,896 | 8/1951 | Gustafsson et al. . | |
| 2,755,137 | 7/1956 | Hughf | 239/597 X |
| 2,953,305 | 9/1960 | Bondurant . | |
| 3,181,798 | 5/1965 | Wahlin et al. | 239/601 X |
| 3,182,950 | 5/1965 | Stone . | |
| 3,865,314 | 2/1975 | Levey et al. | 239/599 X |
| 4,544,100 | 10/1985 | Simashkevich et al. . | |

FOREIGN PATENT DOCUMENTS

| | | | |
|---|---|---|---|
| 2088748 | 6/1982 | United Kingdom | 239/600 |

OTHER PUBLICATIONS

Rimrock Corp., Catalog C-69.
Rimrock Corp., Catalog-"Nozzle Model 011" (1-15).

*Primary Examiner*—Andres Kashnikow
*Assistant Examiner*—Mary Beth O. Jones
*Attorney, Agent, or Firm*—Harness, Dickey & Pierce

[57] ABSTRACT

A spray orifice particularly adapted for discharging a mixture of an atomized release agent entrained within a gas stream for coating a surface of a forming die. The orifice includes a body section having an internal cavity terminating in a ball-shaped cavity portion adjacent its outlet end. The outside surface of the body adjacent the outlet end has a shape complementary with the inside surface to provide a relatively uniform wall thickness. A laterally extending slot is cut into the end and has a maximum width at its center and tapers to a minimum width at its lateral ends. Such configuration reduces the likelihood of finely atomized liquids dispersed in the pressurized gas stream from recombining to form larger size droplets. The included angle of discharge from the slot is adjustable through a rotatable adjustment cap having diametrically opposite cam surfaces which selectively cover side portions of the slot. A lock nut is used to maintain the adjustment cap in a desired set position.

2 Claims, 6 Drawing Figures

ATOMIZED LIQUID SPRAY ORIFICE

BACKGROUND AND SUMMARY OF THE INVENTION

This invention relates to a spray orifice and particularly to one adapted for discharging a mixture of atomized liquid entrained within a gas stream for coating a surface with the liquid.

Molding, casting and forming dies used in workpiece fabrication processes frequently require a very thin and uniformly distributed coating of a release agent on their forming surfaces to enable the workpiece to be easily removed from the machine. Typical devices for applying release agents have two primary components: a nozzle and an orifice. The nozzle component is a fluid control device which mixes together pressurized gas (typically air) and a liquid release agent. The orifice component releases the mixture in a controlled pattern which is directed at the surfaces to be coated. In some applications, the nozzle and orifice components are physically incorporated into a unitary assembly. In other applications, one or more orifices are remotely mounted from the associated nozzle and conduits are used to transfer the pressurized gas and liquid to the orifices.

In one type of presently available orifice, the mixture is discharged through an elongated laterally extending slot which produces a fan-shaped discharge pattern. Although presently available orifices of this type generally perform satisfactorily, designers are continually striving to improve their performance. Presently available orifices have a tendency to cause the finely atomized liquid entrained within the pressurized gas to "recoalesce" to form larger drops which are deposited in a non-uniform manner on the surface being coated. When applying die release agents, such uneven application may lead to uneven "spot" cooling of the die surfaces and additionally wastes release material.

The improved orifice in accordance with this invention provides finely divided, uniformly distributed spray of atomized liquid such as a die release agent. The present orifice includes an inside cavity in the form of a curved surface of revolution. The mixture is discharged from the orifice through a slot passing through the inside cavity having a minimum width at its lateral ends and an increasing width at its center. In addition, the thickness of the tip in the region surrounding the slot is of a substantially uniform thickness. These inventors have found that such design features reduce the likelihood of atomized liquid recoalescing to form large droplets, thus providing a highly uniform distribution of liquid in the discharged spray.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
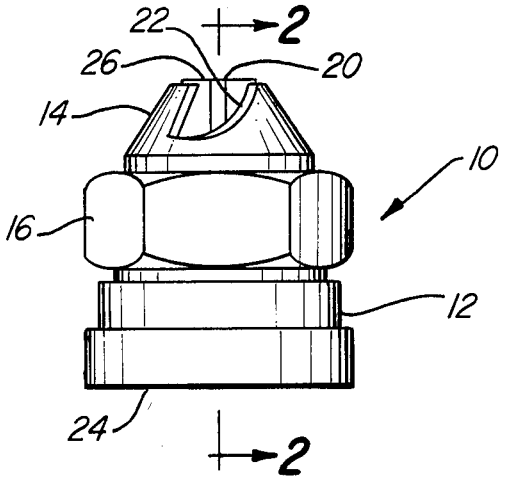
Fig-1 PRIOR ART
FIG. 1 is a side elevational view of a spray orifice in accordance with a prior art design.
Figure 2:
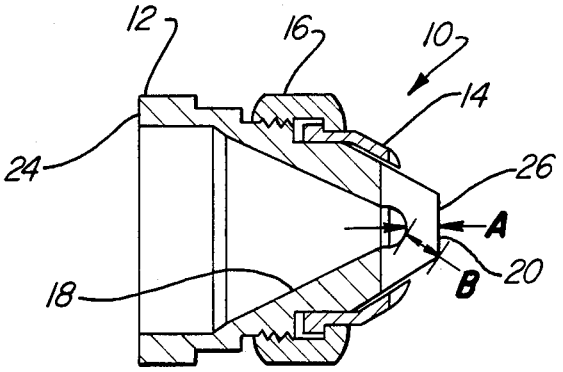
Fig-2 PRIOR ART
FIG. 2 is a cross-sectional view taken along line 2—2 of FIG. 1.
Figure 3:
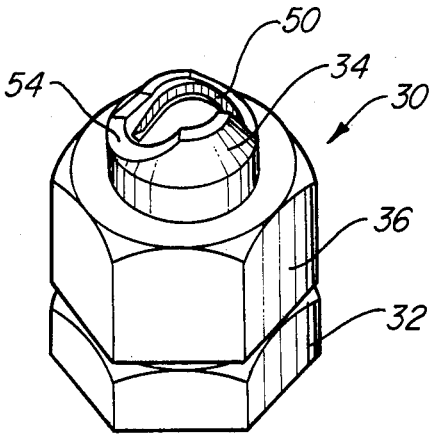
FIG. 3 is a pictorial view of a spray orifice in accordance with this invention.

FIGS. 1 and 2 illustrate a spray orifice in accordance with a prior art design which is generally designated by reference number 10. Orifice 10 is generally comprised of body 12, adjustment cap 14, and lock nut 16. FIG. 2 is a cross-sectional view particularly showing the internal construction details of orifice 10. Body 12 defines an inlet end 24, an outlet end 26, and a frustal-conical shaped inside cavity 18 near the outlet end. The exterior surface of body 12 extends beyond the terminal end of cavity 18. A lateral slot 20 having a uniform width as viewed in FIG. 1 is provided through a diameter of the end of body 12 to define a fluid discharge passage. Adjustment cap 14 generally surrounds body outlet end 26 and is rotatable thereabout. A pair of diametrically opposite cam slots 22 are provided within adjustment cap 14 which enables the included angle of discharge of spray from slot 20 to be varied to suit a particular application. Lock nut 16 retains adjustment cap 14 in a desired rotational orientation with respect to slot 20.

In operation, a pressurized gas (typically air) is transmitted to orifice 10 with an atomized liquid mixed therein. This mixture is transported into the inlet end of cavity 18 via inlet end 24 and flows through cavity 18. Due to the shape of cavity 18, the fluid mixture undergoes compression as it approaches slot 20. While flowing through slot 20, the fluid mixture travels across a wall defined between cavity 18 and the external surface of body 12 of uneven thicknesses. With reference to FIG. 2, such thickness variations are evident by comparing dimension A which is less than dimension B. It has been observed that an orifice constructed in accordance with the above description of orifice 10 does not provide uniform dispersion of liquid in the discharged spray which is believed to be at least partially attributable to the considerable compression of the mixture as it approaches slot 20. Furthermore, the uneven wall thickness described above appears to contribute to the recoalescing phenomena mentioned above. These inventors believe that such recoalescing occurs due to the generation of eddy currents around the orifice discharge opening which causes the fluid to fold back onto itself as it starts to expand, causing minute droplets to impact with other droplets such that they combine into larger droplets.

FIGS. 3 through 6 illustrate a spray orifice in accordance with the present invention which is generally designated by reference number 30. Spray orifice 30 principally comprises body 32, adjustment cap 34, and lock nut 36.

Figure 4:
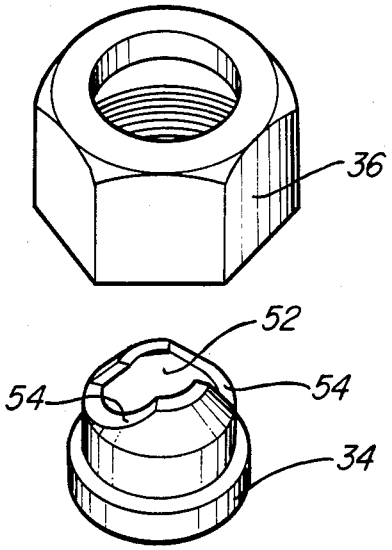
FIG. 4 is an exploded pictorial view of the spray orifice of FIG. 3.
Figure 4:
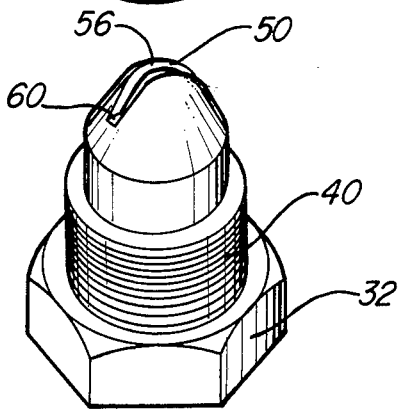
Figure 5:
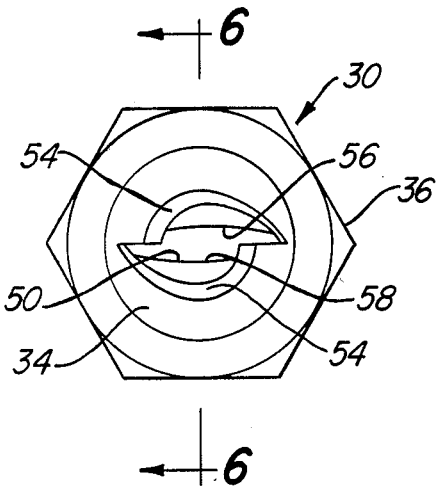
FIG. 5 is a top view of the spray orifice shown in FIG. 3.
Figure 6:
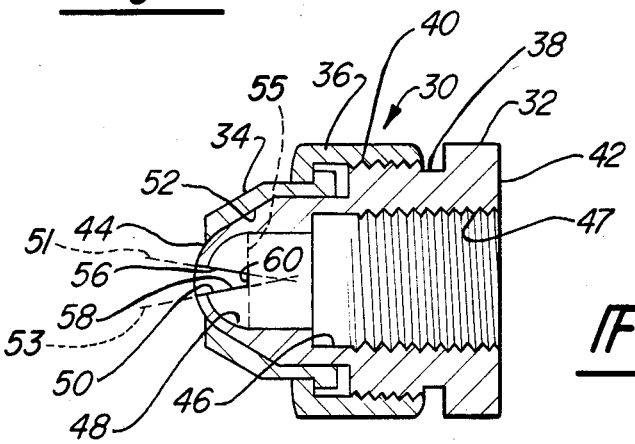
FIG. 6 is a cross-sectional view taken along line 6—6 of FIG. 5.

The internal configuration of body 32 is best described with reference to FIG. 6. Body 32 has a generally cylindrical portion 38 forming screw threads 40 with an inlet end 42 and an outlet end 44. The external surface of body 32 adjacent outlet end 44 has a ball or rounded configuration which is defined as a curved surface of revolution. Body 32 defines an inside cavity with a first cylindrical cavity portion 46 opening at inlet end 42. Cavity portion 46 may define internal screw threads 47 enabling orifice 30 to be threaded onto associated plumbing. The inside cavity of body 32 terminates at outlet end 44 in a generally ball-shaped cavity portion 48 which is also defined by a curved surface of revolution. Body outlet end 44 defines a laterally extending slot 50 which has a non-uniform width that starts at a minimum dimension at its lateral sides and increases to a maximum width dimension at its center as best shown in FIGS. 5 and 6. Slot 50 is defined by a pair of nonparallel planes 51 and 53 shown by phantom lines in FIG. 6 defining slot surfaces 56 and 58, respectively and bottom surfaces 60 defined by a plane 55 perpendicular to the longitudinal axis of orifice 30. As best shown in FIG. 4, the thickness of body 32 in the region of slot 50 is substantially uniform such that the fluid being discharged from the orifice passes across a consistent thickness of material as it is discharged from the slot.

Adjustment cap 34 defines an inside surface 52 which closely conforms to the exterior surface of body 32 at outlet end 44. Adjustment cap 34 further defines a pair of diametrically opposed cam slots 54 which enable the included angle of spray discharged from slot 50 to be varied by rotating the cap with respect to the body. Such rotation selectively covers side portions of slot 50 to decrease the angle of discharge. Lock nut 36 threads onto screw threads 40 and enables adjustment cap 34 to be maintained in a desired rotational position with respect to body 32.

In operation of spray orifice 30, pressurized gas with atomized liquid mixed therein is transmitted to the orifice through inlet end 42. This mixture communicates with inside cavity portion 48 which has a relatively large cross-sectional area to reduce restrictions of flow and thus acts as a manifold which supplies fluid to slot 50. These inventors have found that the inclined surfaces of slot 50 and the constant thickness of the body in the region of the slot combine to reduce the tendency of atomized droplets to recoalesce into larger droplets. Accordingly, a highly uniform fully atomized spray is provided by spray orifice 30.

While the above description constitutes the preferred embodiments of the present invention, it will be appreciated that the invention is susceptible to modification, variation and change without departing from the proper scope and fair meaning of the accompanying claims.

What is claimed is:

1. A spray orifice adapted for discharging a mixture of atomized liquid entrained within a gas stream for coating a surface with said liquid, comprising:

a body member having an inlet end and an outlet end, said inlet end being unobstructed and said outlet end having an exterior surface defined by a curved surface of revolution and a laterally extending slot defined by a pair of nonparallel planes through said outlet end having a minimum width at its radially outer ends and a maximum width at its center, said body member further defining an inside cavity adjacent said outlet end defined by a curved surface of revolution such that the thickness of said body member at said discharge end is substantially uniform in the regions defining the edges of said slot wherein said mixture of atomized liquid entrained within a gas stream supplied through said inlet end is discharged through said slot in a fan-shaped pattern; and an adjustment cap member which closely conforms to said body member at said outlet end and defines a pair of opposed cam surfaces, said cam surfaces enabling the pattern of discharge from said slot to be varied by selectively covering portions of said slot as said adjustment cap is rotated with respect to said body member.

2. The spray orifice according to claim 1 further comprising a lock nut threading onto said body member and engaging said adjustment cap to maintain said adjustment cap in a selected rotated position with respect to said body member.

* * * * *